US005579578A

United States Patent [19]

Ashley, Jr.

[11] Patent Number: 5,579,578

[45] Date of Patent: Dec. 3, 1996

[54] METHOD FOR PRODUCING A RIM FOR A VECHICLE WHEEL

[75] Inventor: Walter L. Ashley, Jr., Detroit, Mich.

[73] Assignee: Hayes Wheels International, Inc., Romulus, Mich.

[21] Appl. No.: 144,113

[22] Filed: Oct. 27, 1993

[51] Int. Cl.[6] ..... B21H 1/02

[52] U.S. Cl. ..... 29/894.322; 29/894.353; 29/894.354; 72/68; 72/105

[58] Field of Search ..... 29/894.35, 894.353, 29/894.354, 894.322; 72/68, 105, 84, 85

[56] References Cited

U.S. PATENT DOCUMENTS

| | | | |
|---|---|---|---|
| 3,129,496 | 4/1964 | Cox | 72/206 |
| 3,347,302 | 10/1967 | Lemmerz . | |
| 4,127,022 | 11/1978 | Bosch | 29/894.353 |
| 4,143,533 | 3/1979 | Bosch . | |
| 4,185,370 | 1/1980 | Evans . | |
| 4,962,587 | 10/1990 | Ashley, Jr. et al. . | |

FOREIGN PATENT DOCUMENTS

| | | | |
|---|---|---|---|
| 55-24705 | 2/1980 | Japan | 72/85 |
| 59-92123 | 5/1984 | Japan | 72/85 |
| 61-286030 | 12/1986 | Japan | 72/85 |
| 4055029 | 2/1992 | Japan . | |

OTHER PUBLICATIONS

Patent Abstracts of Japan, vol. 16, No. 245 (M–1260), Jun. 4, 1992.

Patent Abstracts of Japan, vol. 4, No. 72 (M–013), May 27, 1990.

Patent Abstracts of Japan, vol. 14, No. 351 (M–1003), Jul. 30, 1990.

American Society for Metals Metals Handbook, Jun. 1969, pp. 317–322.

*Primary Examiner*—P. W. Echols

*Attorney, Agent, or Firm*—MacMillian, Sobanski & Todd

[57] ABSTRACT

An improved method is disclosed for producing a wheel rim for use in a vehicle wheel. The method includes the steps of: (a) providing a flat sheet of material; (b) forming the flat sheet into a hoop having a first predetermined axial length; (c) expanding the hoop to a predetermined inner hoop diameter; (d) flow spinning the hoop to produce a wheel rim preform having a second predetermined axial length greater than the first predetermined axial length, the wheel rim preform including opposed axial ends and a thinned axially extending intermediate portion located between the axial ends; (e) subsequent to step (d), flaring at least one axial end of the wheel rim preform; and (f) subsequent to step (e), subjecting the wheel rim preform to a series of roll forming operations to produce a finished wheel rim having at least one tire bead seat retaining flange, at least one tire bead seat surface, and a generally axially extending well.

6 Claims, 4 Drawing Sheets

METHOD FOR PRODUCING A RIM FOR A VECHICLE WHEEL

BACKGROUND OF THE INVENTION

This invention relates in general to vehicle wheels and, in particular, to an improved method for producing a rim for a vehicle wheel.

A typical sequence of steps which can be used to produce a wheel rim for a vehicle wheel is disclosed in U.S. Pat. No. 4,185,370 to Evans. As shown in this patent, the method includes the steps of: (a) providing a flat sheet of suitable material, such as aluminum or steel; (b) forming the sheet into a cylindrical hoop or band; (c) flaring the lateral edges of the hoop radially outwardly to produce a rim preform having flanges suitable for positioning on a roll forming machine; (d) subjecting the rim preform to a series of roll forming operations to produce a wheel rim having a predetermined shape; and (e) expanding the wheel rim to a produce a finished wheel rim having a predetermined circumference.

As a result of forming the wheel rim in this manner, the roll forming operations produce a rim having a generally uniform material thickness as the rim is progressively shaped. A slight thinning of the material occurs only at those portions of the rim where the curvature changes and forms a radius. Thus, the generally uniform thickness of the rim results in the rim having extra material at places where it is not required for strength purposes. Since the weight of the wheel rim affects the performance of a vehicle, it is desirable to reduce the weight of the rim.

U.S. Pat. No. 4,962,587 to Ashley, Jr. et al. discloses one method for reducing the weight of a wheel rim by thinning selected portions thereof. According to the method of this patent, a preformed wheel rim is provided having opposed finished tire bead seat retaining flanges, opposed finished tire bead seat surfaces, a well, and an axially extending inboard leg. Next, the well and adjacent rim end are mounted on a mandrel and end plate, respectively, for rotation therewith. A flow spinning roller is then actuated and advanced to engage the well and inboard leg portion thereby thinning-stretching the well and leg portions of the preformed wheel rim.

Other methods for reducing the weight of a wheel rim by thinning selected portions of the rim by rolling or pressing operations are disclosed in U.S. Pat. No. 3,347,302 to Lemmerz, U.S. Pat. No. 4,127,022 to Bosch, and U.S. Pat. No. 4,143,533 to Bosch.

SUMMARY OF THE INVENTION

In the above-discussed Ashley et al. patent, the flow spinning operation to thin-stretch the well and leg portions of the rim preform occurs after the finished tire bead seat retaining flanges and tire bead seat surfaces are formed by roll forming. As a result of this, applicant has found that it is difficult to accurately control the lateral and radial runouts of the finished wheel. Lateral runout as used herein is defined as the flatness and parallelism between the opposed tire bead seat surfaces and flanges, respectively, and radial runout is defined as the roundness of the rim. This invention concerns an improved method for producing a wheel rim which combines flow spinning and roll forming operations to produce a wheel rim which maintains tighter tolerances in the finished wheel rim.

In particular, the method includes the steps of: (a) providing a flat sheet of material; (b) forming the flat sheet into a generally cylindrical hoop having a first predetermined axial length; (c) expanding the hoop to a predetermined inner hoop diameter; (d) flow spinning the hoop to produce a wheel rim preform having a second predetermined axial length greater than the first predetermined axial length, the wheel rim preform including opposed axial ends and a thinned axially extending intermediate portion located between the axial ends; (e) subsequent to step (d), flaring at least one axial end of the wheel rim preform; and (f) subsequent to step (e), subjecting the wheel rim preform to a series of roll forming operations to produce a finished wheel rim having at least one tire bead seat retaining flange, at least one tire bead seat surface, and a generally axially extending well.

Combining the reverse flow spinning and roll forming operations in the above manner produces a wheel rim which better controls the tolerances in the finished rim.

Other advantages of this invention will become apparent to those skilled in the art from the following detailed description of the preferred embodiment, when read in light of the accompanying drawings.

DETAILED DESCRIPTION OF THE PREFERRED EMBODIMENT

Figure 1:
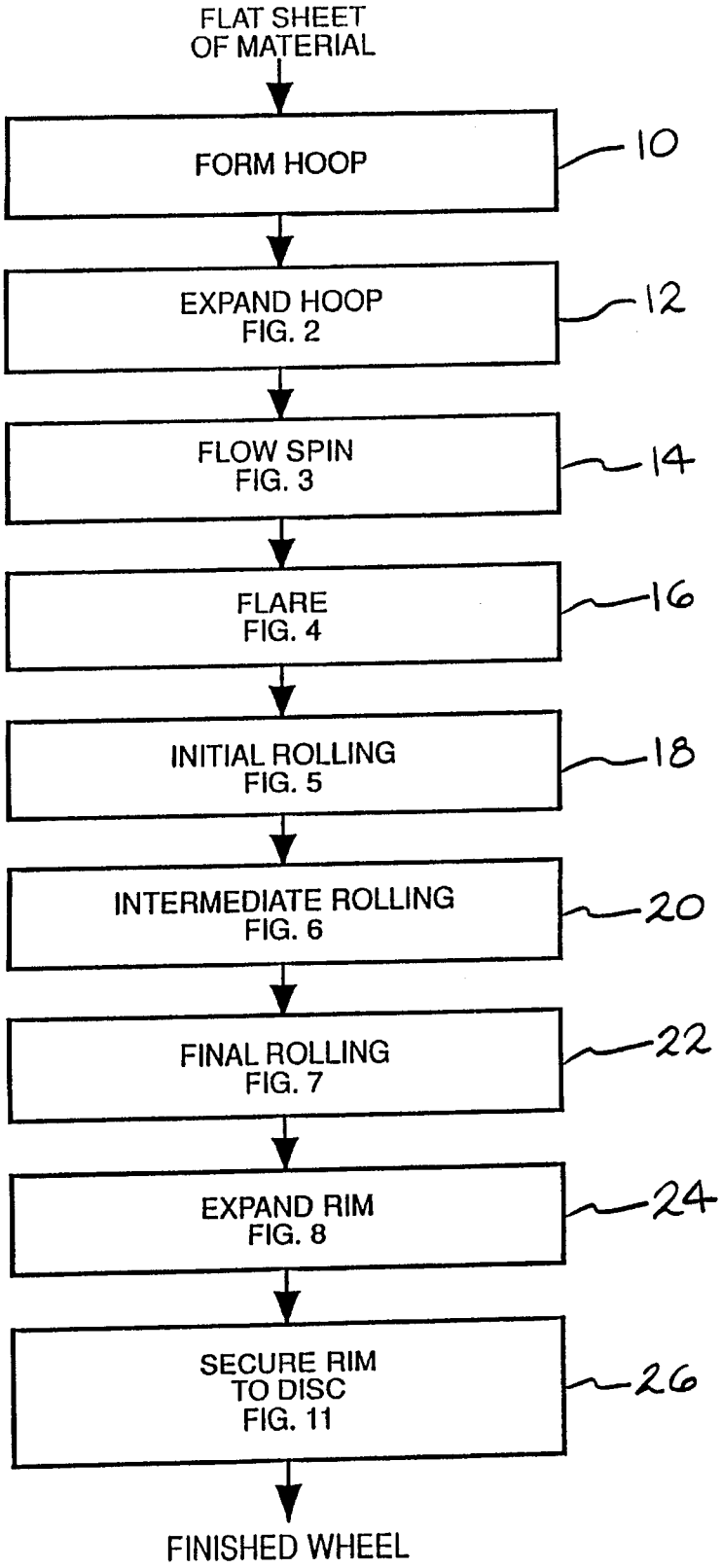
FIG. 1 is a block diagram showing a sequence of steps for producing a wheel rim for use in a vehicle wheel and constructed in accordance with the present invention.
Figure 11:
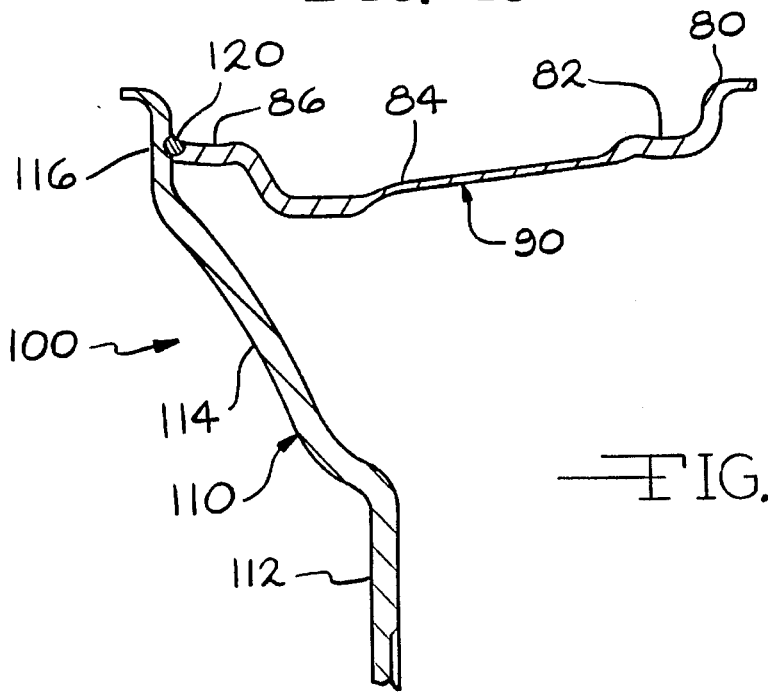
FIG. 11 is a partial sectional view of a finished full face fabricated wheel constructed using a wheel rim constructed in accordance with the present invention.

Referring now to the drawings, there is illustrated in FIG. 1 a block diagram showing a sequence of steps for producing a vehicle wheel 90, such as that shown in FIG. 11, and which incorporates a wheel rim, indicated generally at 100 and constructed in accordance with the present invention. As shown in this embodiment, the vehicle wheel 90 is a full face fabricated wheel. Also, as used herein, the term "flow spinning" shall mean the deformation of metal by pressure under a spinning tool to thin and shape the metal, and the term "roll forming" shall mean the reshaping of metal by pressure under rolls to produce a desired shape.

Figure 2:
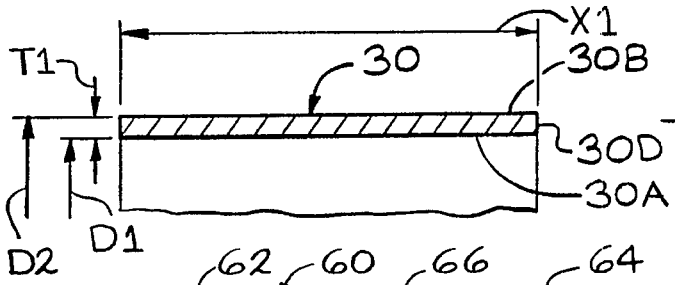
FIG. 2 is a schematic view of the hoop after an expanding operation.

Initially, in step 10, a flat sheet of suitable material, such as for example, steel or aluminum, is formed into a generally cylindrical hoop or band 30 and welded. When the hoop 30 is welded in step 10, a flat surface is created by the weld. As a result of this, and in accordance with the present invention, the hoop 30 is expanded in step 12 to produce a substantially cylindrical hoop 30 shown in FIG. 2. The hoop 30 includes an inner surface 30A which defines a predetermined inner diameter D1, an outer surface 30B which defines a predetermined outer diameter D2, a pair of opposed ends 30C and 30D which define a predetermined axial hoop length X1, and a predetermined thickness T1. As will be discussed below, it is important that the hoop 30 is expanded in step 12 to form the predetermined inner diameter D1.

Figure 9:
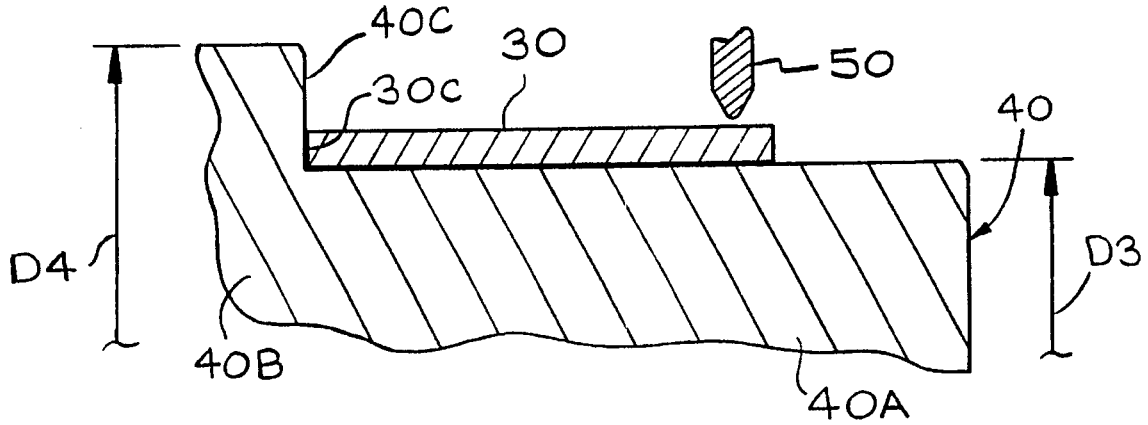
FIG. 9 is a partial sectional view of the hoop prior to performing the flow spinning process.
Figure 10:
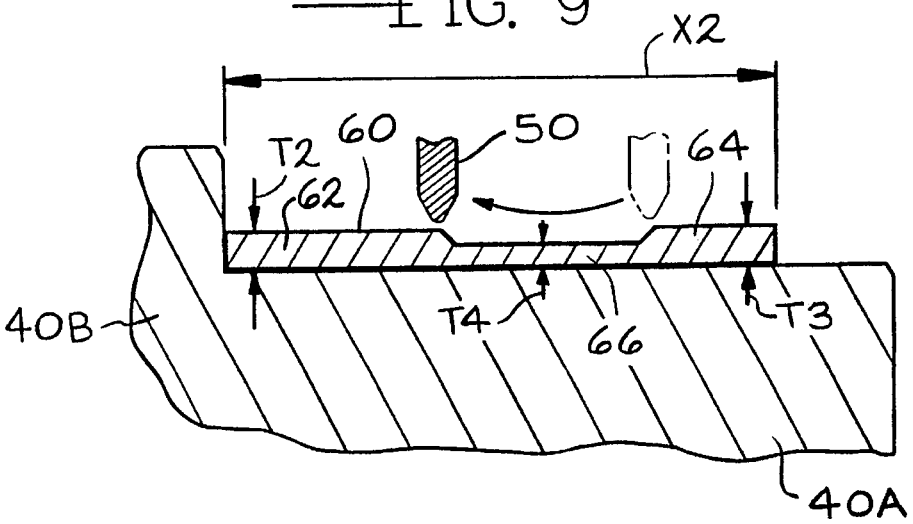
FIG. 10 is a partial sectional view of the hoop produced by the flow spinning operation.

The hoop 30 is then subjected to a flow spinning process in step 14. As shown in FIGS. 9 and 10, the flow spinning process shown in this embodiment is a "reverse" flow spinning process. As will be discussed below, it is preferable to use the reverse flow spinning process rather than a "forward" flow spinning process.

In step 14, the hoop 30 is positioned on a mandrel 40 shown in FIG. 9. The mandrel 40 is rotatably mounted on a lathe (not shown), and includes a main body 40A which defines a predetermined outer diameter D3, and an end portion 40B which defines a predetermined outer diameter D4 which is greater than the outer diameter D3. A shoulder or stop 40C is defined between the main body 40A and the end portion 40B of the mandrel 40. The outer diameter D3 of the main body 40A of the mandrel 40 generally corresponds to the inner diameter D1 of the hoop 30 formed during expanding step 12 so as to create a friction fit therebetween when the hoop 30 is positioned on the mandrel 40. Thus, relative movement between the hoop 30 and the mandrel 40 is restricted.

Once the hoop 30 is positioned on the mandrel 40 with the hoop end 30C abutting mandrel shoulder 40C, a spinning tool 50 is moved to a predetermined position relative to the shoulder 40C and adjacent the outer surface 30B of the hoop 30. The spinning tool 50 is mounted on a support member (not shown) which allows the spinning tool 50 to generally travel parallel to the outer surface of the mandrel 40.

In step 14, the spinning tool 50 is actuated and moves radially inwardly into engagement with the outer surface 30B of the hoop 30 and is advanced in the direction of the arrow toward the mandrel shoulder 40C, i.e., to the left in the drawing. During the flow spinning process of step 14, the material of the hoop 30 is engaged by the end of the spinning tool 50 and is pushed forward by the tool 50.

Since the expanding of the hoop 30 in step 12 produced a predetermined inner diameter D1 which is generally equal to the outer diameter D3 of the main body 40A of the mandrel 40, and since the hoop end 30C is positioned against the mandrel shoulder 40C, as the spinning tool 50 is advanced the material of the hoop 30 must flow in a direction which is opposite or reverse to the direction of movement of the spinning tool 50, i.e., to the right in FIG. 10.

Figure 3:
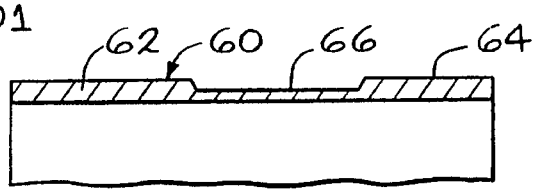
FIG. 3 is a schematic view of a wheel rim preform produced by a flow spinning process.

The spinning tool 50 continues to be advanced until it reaches a predetermined distance measured from the mandrel shoulder 40C. Once the spinning tool 50 reaches the predetermined distance, the tool 50 is withdrawn thereby producing a wheel rim preform 60 shown in FIGS. 3 and 9. Also, by predetermining a feed rate and rpm of the spinning tool 50, and the entrance and exit points of the spinning tool 50, the resultant axial length of the wheel rim preform 60 produced by the reverse flow spinning process of step 14 can be accurately controlled.

As shown in this embodiment, the wheel rim preform 60 formed during reverse flow spinning step 14 includes a pair of opposed axial end portions 62 and 64, and an axially extending intermediate portion 66 located between the ends 62 and 64. The wheel rim preform also includes a predetermined axial length X2 which is greater than the axial length A1 of the hoop 30.

The end portions 62 and 64 of the wheel rim preform 60 include a substantially uniform thickness T2 and T3, respectively, throughout their entire axial lengths, and the intermediate portion 66 includes a substantially constant thickness T4 throughout its entire axial length. The thicknesses T2 and T3 of the end portions 62 and 64 are generally equal to one another, and the thickness T4 of the intermediate portion 66 is less than the thicknesses T2 and T3 of the end portions 62 and 64, respectively. Also, the thicknesses T2 and T3 of the end portions 62 and 64, respectfully, are generally equal to the thickness T1 of the hoop 30.

Figure 4:
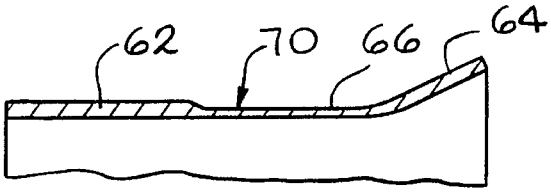
FIG. 4 is a schematic view of the wheel rim preform produced by a flaring operation.
Figure 5:
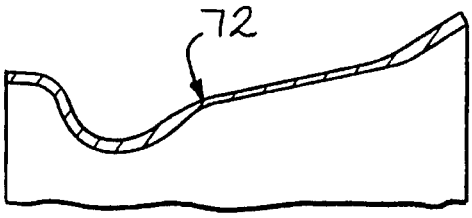
FIG. 5 is a schematic view of a partially-shaped wheel rim produced by an initial roll forming operation.
Figure 6:
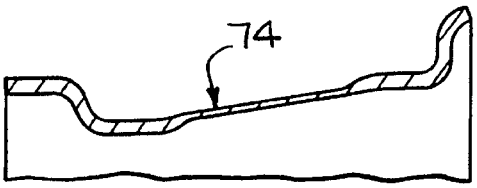
FIG. 6 is a schematic view of the partially-shaped wheel rim produced by an intermediate roll forming operation.
Figure 7:
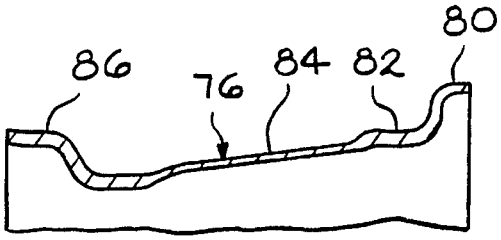
FIG. 7 is a schematic view of the partially-shaped rim produced by a final roll forming operation.
Figure 8:
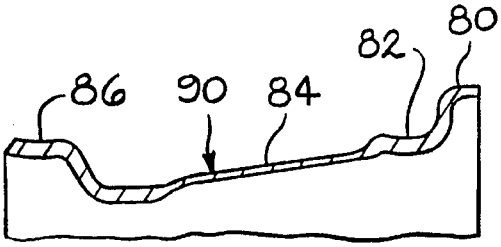
FIG. 8 is a schematic view of the finished wheel rim produced by an expanding operation.

Next, in step 16, the end portion 64 of the wheel rim preform 60 is flared upwardly as shown in FIG. 4 to produce a wheel rim 70. Next, in steps 18–22, the rim 70 is subjected to a series of roll forming operations, as shown in FIGS. 5, 6, and 7 to progressively produce wheel rims 72, 74, and 76, respectively. The wheel rim 76 includes an inboard tire bead seat retaining flange 80, an inboard tire bead seat 82, a generally axially extending well 84, and an outboard tire bead seat 86. Next, in step 24, the wheel rim 76 is expanded to produce the finished wheel rim 90.

The wheel rim 90 is secured to a preformed full face wheel disc 110 during step 26 to produce the finished full face fabricated wheel 100. As shown in FIG. 11, the wheel disc 110 includes a central mounting surface 112, an intermediate bowl-shaped portion 114, and an outer annular portion 116 which defines an outboard tire bead seat retaining flange of the fabricated wheel 100. The disc 110 can be a formed steel or aluminum disc depending upon the construction of the associated wheel rim.

In particular, during step 26, the outboard end of the rim 90 is positioned against an inner surface 116A of the outboard tire bead seat retaining flange 116 of the disc 110, and a circumferential weld 120 is applied to secure the rim 90 and disc 110 together to produce a finished full face fabricated wheel 100.

Since the present invention performs the roll forming of steps 18–22 after the flow spinning of step 14, tighter tolerances can be maintained in the finished wheel rim 90. In the particular embodiment shown in FIG. 11, the lateral and radial runouts in the rim 90 of the present invention are more accurately maintained than they are in the prior art. Thus, less scrap material is produced when the wheel rim is produced according to the method of the present invention.

While the invention has been described and illustrated as using a reverse flow spinning operation in step 14, a forward flow spinning operation can be used. However, since a forward flow spinning process typically requires that one end of the rim be clamped in place against the mandrel, the tooling costs associated with this process are higher compared to the tooling costs associated with the reverse flow spinning process of the present invention.

Figure 12:
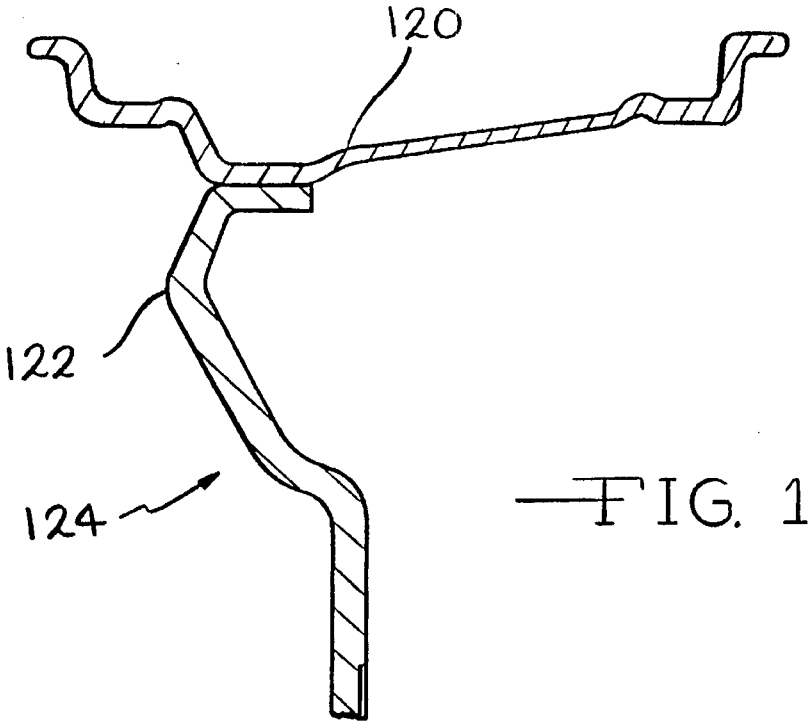
FIG. 12 is a partial sectional view of a finished conventional fabricated wheel constructed using an alternate embodiment of a wheel rim constructed in accordance with the present invention.
Figure 13:
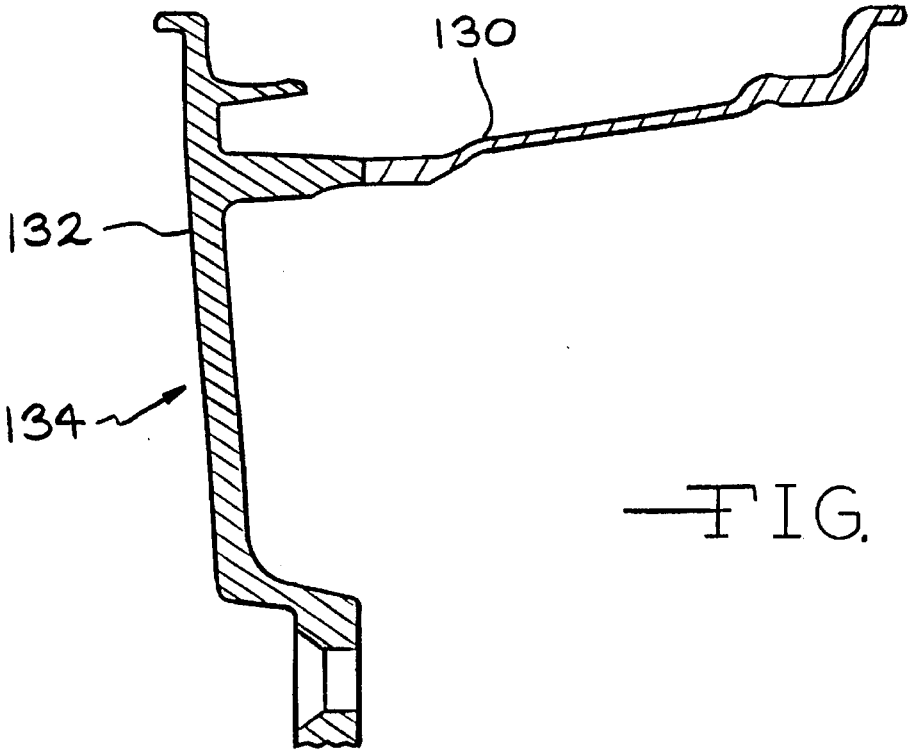
FIG. 13 is a partial sectional view of a finished full face modular wheel constructed using another alternate embodiment of a wheel rim constructed in accordance with the present invention.

Also, while the invention has been described and illustrated as forming a wheel rim 90 for use in a full face fabricated wheel 100, the invention can be practiced to form an associated wheel rim for use in other types of wheels. For example, as shown in FIG. 12, the invention can be practiced to produce a wheel rim 120, which is secured to a wheel disc 122 to produce a conventional fabricated wheel, indicated generally at 124. When the invention is utilized to produce the wheel rim 120, both ends of the wheel rim formed by the flow spinning operation of step 14 are flared upwardly during step 16. Also, as shown in FIG. 13, the invention can be practiced to produce a partial wheel rim 130, which is secured to a cast full face wheel disc 132 to produce a full face modular wheel, indicated generally at 134.

In accordance with the provisions of the patent statutes, the principle and mode of operation of this invention have been described and illustrated in its preferred embodiment. However, it must be understood that the invention may be practiced otherwise than as specifically explained and illustrated without departing from the spirit or scope of the attached claims.

What is claimed:

1. A method for producing a rim for a vehicle wheel comprising the steps of:

(a) providing a flat sheet of material;

(b) forming the flat sheet into a generally cylindrical hoop having a first predetermined axial length;

(c) providing a mandrel defining a shoulder;

(d) positioning the hoop on the mandrel with one end of the hoop adjacent the shoulder of the mandrel;

(e) positioning a spinning tool of a flow spinning machine a predetermined distance from the shoulder with an end of the spinning tool in contact with an outer surface of the hoop;

(f) operating the flow spinning machine whereby the spinning tool is moved in a direction toward the shoulder of the mandrel causing the material to flow in a direction opposite to the direction of movement of the spinning tool to axially stretch and thin the hoop to produce a wheel rim preform having a second predetermined axial length greater than the first predetermined axial length, the wheel rim preform included opposed axial ends and a thinned axially extending intermediate portion located between the axial ends; and (g) subsequent to step (f), subjecting the wheel rim to a series of metal forming operations to produce a finished wheel rim having at least one tire bead seat retaining flange, at least one tire bead seat surface, and a generally axially extending well.

2. The method according to claim 1 and including securing the finished wheel rim of step (g) to a preformed wheel disc to produce a full face fabricated vehicle wheel.

3. The method according to claim 1 and further including flaring at least one axial end of the wheel rim preform prior to performing the roll forming operations of step (g).

4. The method according to claim 3 wherein both axial ends of the wheel rim preform are flared and the finished wheel rim includes a pair of opposed tire bead seat retaining flanges and a pair of opposed tire bead seat surfaces, and further including securing the finished wheel rim to a preformed wheel disc to produce a conventional fabricated vehicle wheel.

5. The method according to claim 1 and including securing the finished wheel rim of step (g) to a preformed wheel disc to produce a full face modular vehicle wheel.

6. The method according to claim 1 and further including expanding the hoop to a predetermined inner hoop diameter prior to performing step (d).

* * * * *